United States Patent [19]

Garrison

[11] 3,986,370

[45] Oct. 19, 1976

[54] APPARATUS FOR CONNECTING MOTORS IN TANDEM

[75] Inventor: Marion A. Garrison, Denver, Colo.

[73] Assignee: Empire Oil Tool Company, Denver, Colo.

[22] Filed: Apr. 7, 1975

[21] Appl. No.: 566,017

[52] U.S. Cl. ..... 64/23; 64/6; 175/107; 403/356; 285/91; 418/210

[51] Int. Cl.[2] ..... F16D 3/06

[58] Field of Search ..... 175/107; 415/502; 418/202, 210; 285/333, 91; 64/23, 6; 403/356, 305

[56] References Cited

UNITED STATES PATENTS

| | | | |
|---|---|---|---|
| 2,843,090 | 2/1958 | Walker | 418/210 |
| 2,927,804 | 3/1960 | Snyder et al. | 285/91 |
| 3,291,230 | 12/1966 | Cullen et al. | 175/107 |
| 3,554,589 | 1/1971 | Boggs | 403/356 |
| 3,603,624 | 9/1971 | Attermeyer | 403/356 |

*Primary Examiner*—Samuel Scott
*Assistant Examiner*—Randall Heald
*Attorney, Agent, or Firm*—Vincent G. Gioia; Robert F. Dropkin

[57] ABSTRACT

Apparatus for connecting motors in tandem and particularly in vertical alignment includes a coupling for connecting the lower end of the shaft of the upper motor to the upper end of the shaft of the lower motor. A tubular member surrounds the coupling with its upper end extending into the outer housing of the upper motor and its lower end threaded into the outer housing of the lower motor. A lock ring surrounds the tubular member and has a keyed connection with the outer housing of the lower motor. The upper end of the lock ring and the lower end of the outer housing preferably have ten equally spaced keyways therein. A key extends into a pair of matching keyways of the lock ring and upper outer housing and screws hold the keys in place by passing through aligned holes in the lock ring and upper outer housing into threaded holes in the tubular member.

11 Claims, 4 Drawing Figures

APPARATUS FOR CONNECTING MOTORS IN TANDEM

This invention relates to apparatus for connecting motors in tandem and more particularly to so connecting deep oil well motors such as those disclosed in my U.S. Pat. Nos. 2,852,230, dated Sept. 16, 1956; 3,076,514, dated Feb. 5, 1963; and 3,594,106, dated July 20, 1971; as well as in my copending application entitled Fluid Driven Motor Having Improved Blade Construction, Ser. No. 545,866, filed Jan. 31, 1975. These motors are driven by fluid drilling mud. Such mud usually contains abrasive or gritty materials which can damage parts of the motor especially at high speeds and heavy loads. For this and other reasons it is desirable in some situations to use a plurality of motors connected in tandem. When using multiple motors, it is necessary that the final assembly be stiff and strong since it may handle as much as 80,000 pounds of weight on the drill bit under severe conditions such as the vibration caused by the rotating bit. The torque reaction of the motor also tends to cause unscrewing of any threaded part of the connection. For best operation the joint must be leak proof so as to prevent leakage of fluids into or out of the joint.

The broad idea of connecting motors in tandem is not new as is shown in Works et al, U.S. Pat. No. 2,990,895, dated July 4, 1961 and Marshall, U.S. Pat. No. 3,299,825, dated Jan. 24, 1967. However, any of the motor connections of which I have knowledge have various drawbacks. Their cost of manufacture may be high, they may lack sufficient strength of thickness for best operation, they may not be leak proof, they may tend to come apart in use if not closely watched and/or it may be difficult or impossible to add or take away a motor in the field. In this later case, the versatility of the motor drive is restricted since it cannot be used under widely varying conditions at least without decreasing its efficiency under some of the varying conditions.

It is therefore an object of my invention to provide apparatus for connecting motors in tandem which connection is strong, stiff and leak proof.

Another object is to provide such apparatus which permits removal or addition of motors with relative ease.

Still another object is to provide such apparatus which is particularly suitable for deep well drilling.

These and other objects of the invention will become apparent on referring to the following detailed description and attached drawings in which.

Figure 1:
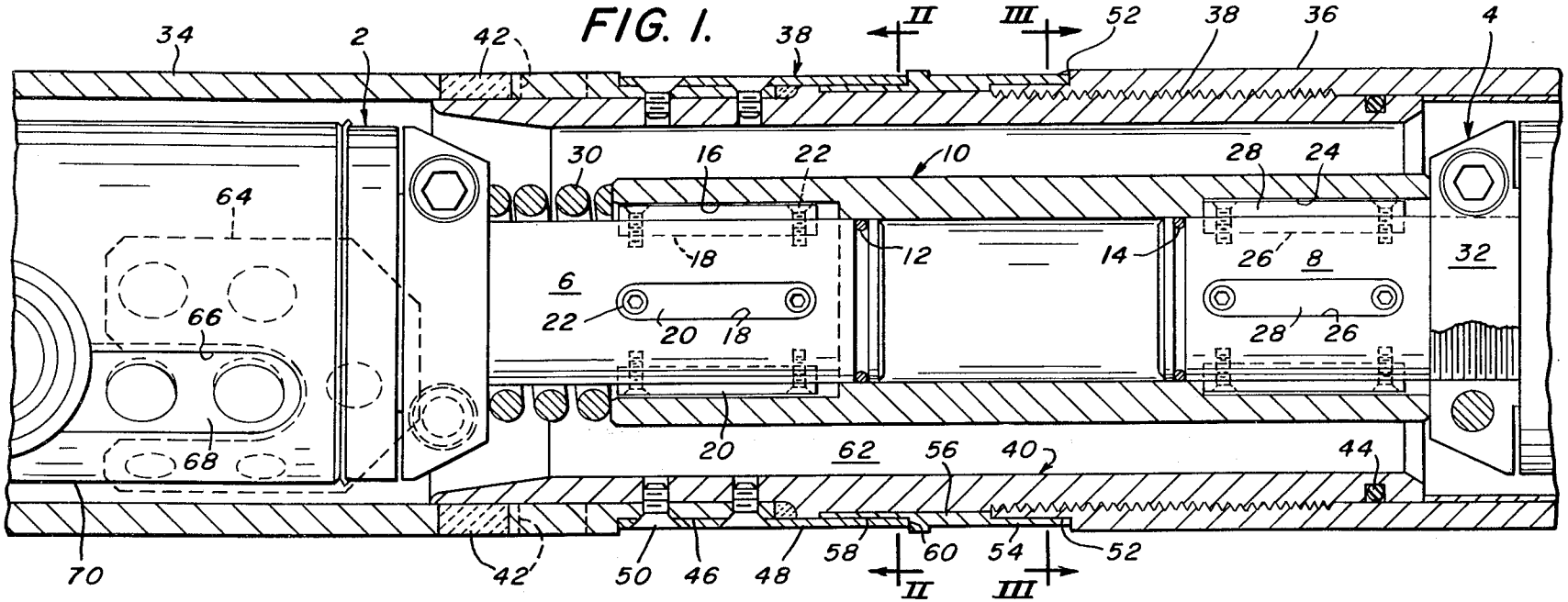
FIG. 1 is a longitudinal sectional view of my improved connection.

Referring more particularly to the drawings, reference numeral 2 indicates the top motor and reference numeral 4 the bottom motor of a drive for use in drilling deep oil wells. The motors 2 and 4 are preferably of the type disclosed in my copending applications Ser. No. 545,866, filed Jan. 31, 1975 entitled "Fluid Driven Motor Having Improved Blade Construction" and Ser. No. 556,079 filed Mar. 6, 1975, entitled "Inlet and Outlet Ports and Sealing Means For A Fluid Driven Motor," or in my prior U.S. Pat. Nos. 3,594,106 dated July 20, 1971; U.S. Pat. 3,076,514 dated Feb. 5, 1963 or U.S. Pat. No. 2,852,230 dated Sept. 16, 1958. The motors 2 and 4 have shafts 6 and 8, respectively, which are in axial alignment but separated from one another. The shafts 6 and 8 are connected by means of a coupling 10 which surrounds the ends thereof. Seals 12 and 14 are provided at the end of shafts 6 and 8, respectively in sealing engagement with the bore of coupling 10. The top end of coupling 10 has four internal keyways 16 equally spaced around its periphery. The shaft 6 has four keyways 18 equally spaced around its periphery and in alignment with keyways 16. A key 20 in each set of keyways is attached to shaft 6 by means of screws 22. In like manner the lower end of coupling 10 has similar keyways 24 therein aligned with keyways 26 in shaft 8 and a key 28 in each set of keyways attached to shaft 8. The key connections are such that the shafts 6 and 8 will rotate in unison, but may move a limited amount axially with respect to one another. A helical spring 30 surrounds the shaft 6 with one end bearing against motor 2 and its other end bearing against coupling 10 so as to hold the lower end of coupling 10 against locknut 32 of motor 4.

Figure 2:
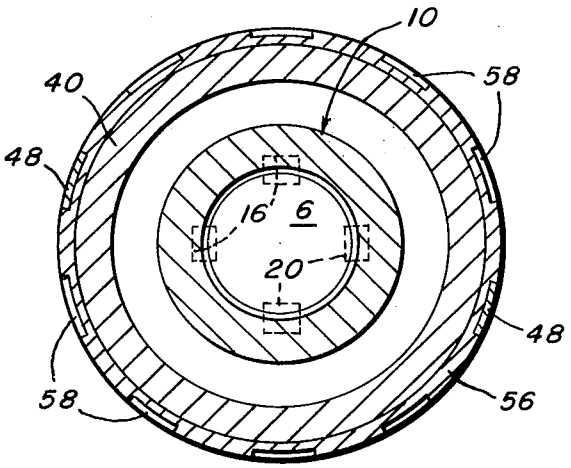
FIG. 2 is a view taken on the line II—II of FIG. 1.
Figure 3:
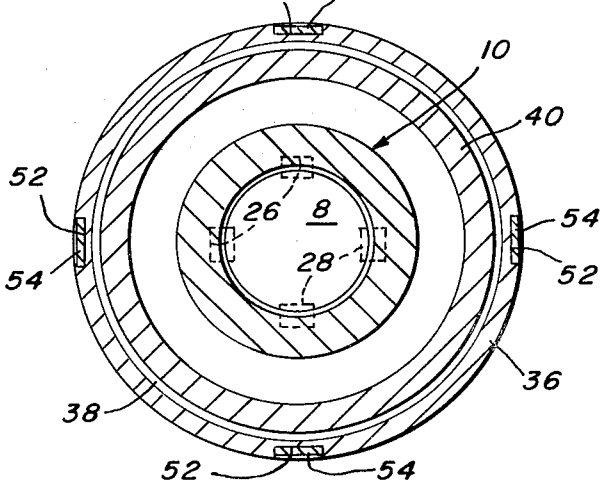
FIG. 3 is a view taken on the line III—III of FIG. 1.
Figure 4:
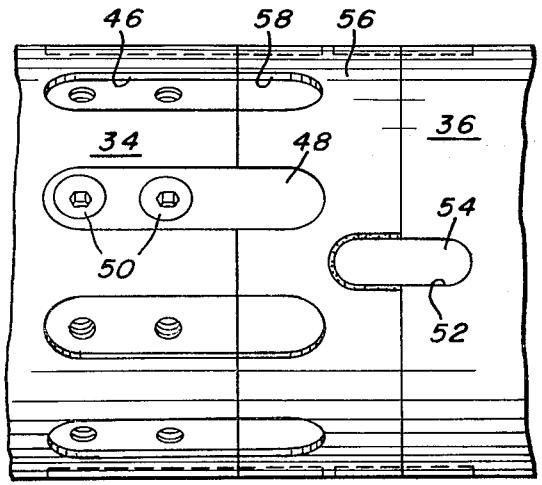
FIG. 4 is a partial side elevation of FIG. 1 showing a detail.

Outer tubular housing 34 of the upper motor 2 is connected to the outer tubular housing 36 of the lower motor 4 by a connection 38. The housings 34 and 36 may be 6½ in. outside diameter seamless tubing with ⅜ in. walls. The housing 36 has an internal tapered thread 38 for receiving a matching thread on a tubular member 40 which is preferably machined from a 6 in. outside diameter seamless tube having a ½ in. wall thickness. The tube 40 extends to and is welded to the end of housing 34 by means of two peripheral rows of spaced apart plug welds 42 or any other suitable means. A seal 44 is provided in tube 40 at its lower end. As best shown in FIGS. 1, 2 and 4, the lower or outer end of housing 34 has 10 slots or keyways 46 therein. Lock keys 48 which extend beyond the lower end of housing 34 are received in two diametrically opposed keyways 46 and are attached to housing 34 by means of countersunk head cap screws 50 passing through aligned holes in housing 34, tube 40 and key 48. The upper end of housing 36 has four slots 52 therein equally spaced around its periphery for receiving keys 54 of a lock ring 56 which surrounds tube 40 in close engagement therewith. This is preferably machined from a 6½ in. outside diameter seamless tubing 2½ in. long with a 5/16 in. wall and with the keys 54 welded thereto. The upper end of lock ring 56 has ten slots or keyways 58 equally spaced around its periphery and of such width as to receive the lock keys 48. The ring 56 has a shoulder 60 against which the lock keys 48 abut. It will be seen that a space 62 is provided between coupling 10 and tube 40 so as to provide a passageway for the fluid drilling mud from upper motor 2 to lower motor 4.

The outer housing 34 preferably has two diametrically spaced locking lugs 64 secured to its inside each having a bottom slot 66 to receive lugs 68 on the inner housing 70 of motor 2.

The joint 38 is assembled as follows: If a second motor is to be added to a motor already in place the valve which normally precedes the motor is removed from its shaft and the coupling 10 is inserted in its place on shaft 8. The tube 40 with seal 44 in place is then placed around coupling 10 and ring 56 is placed around tube 40. Shaft 6 of motor 2 with spring 30 surrounding it can then be moved axially until its keys 20 engage the keyways 16. With the tube 40 welded to housing 34 and the keys 54 abutting the ends of keyways 52 the thread 38 is engaged. The connection preferably is torqued to about 800 ft. lbs. and then turned tighter as required to line up two of the keyways 46 with two of the keyways 58. Two keys 48 are then attached to complete the joint.

As can be seen from the drawing, the parts, except for the seals, are made of metal which is necessary to obtain the required strength and stiffness.

While there has been shown and described one embodiment, it is to be understood that various adaptations and modifications may be made within the scope of the invention.

I claim:

1. Apparatus for connecting motors in tandem, each of said motors including a shaft, an inner housing, and an outer metal housing spaced from said inner housing to provide a passageway therebetween, the outlet end of the shaft of one of said motors being adjacent the inlet end of the shaft of the other of said motors; said apparatus including a metal coupling connecting the adjacent ends of said shafts, a tubular metal member surrounding said coupling with a space therebetween, the ends of said tubular member extending into each of said outer housings in close engagement therewith, internal threads on the end of one of said outer housings, matching threads on said tubular member in engagement with said internal threads, a metal lock ring surrounding said tubular member, a connection between one end of said lock ring and the end of said outer housing having the threads thereon, the other end of said lock ring having a keyway therein, the end of the other of said outer housings having a keyway therein, a key extending into said keyways, and means securing said key in said keyways.

2. Apparatus according to claim 1, including a keyed connection between said coupling and each of said shafts for driving said shafts in unison while permitting axial movement therebetween, a spring surrounding one of said shafts with one end bearing against said coupling and the other end bearing against the adjacent motor to urge said coupling against the other of said motors.

3. Apparatus according to claim 1, in which the threads on said tubular member and outer housing are tapered.

4. Apparatus according to claim 3, including a keyed connection between said coupling and each of said shafts for driving said shafts in unison while permitting axial movement therebetween, a spring surrounding one of said shafts with one end bearing against said coupling and the other end bearing against the adjacent motor to urge said coupling against the other of said motors.

5. Apparatus according to claim 4, in which each of said lock ring and the other of said outer housings has a plurality of keyways therein, and there are keys in a plurality of matching keyways in said lock ring and said other outer housing.

6. Apparatus according to claim 1 in which said motors are arranged vertically and are driven by drilling mud.

7. Apparatus according to claim 6 including locking lugs on the inside of the outer housing of the upper of said motors with upwardly facing slots therein, and lugs on the outside of the inner housing of said upper motor extending into said slots.

8. Apparatus according to claim 7 in which the threads on said tubular member and outer housing are tapered with the threads being on the outer housing of the lower motor.

9. Apparatus according to claim 8, including a keyed connection between said coupling and each of said shafts for driving said shafts in unison while permitting axial movement therebetween, a spring surrounding one of said shafts with one end bearing against said coupling and the other end bearing against the adjacent motor to urge said coupling against the other of said motors.

10. Apparatus according to claim 9, in which each of said lock ring and the other of said outer housings has a plurality of keyways therein, and there are keys in a plurality of matching keyways in said lock ring and said other outer housing.

11. Apparatus according to claim 10 including a fluid seal between each of said shafts and said coupling, and a fluid seal between said tubular member and the outer housing of said lower motor.

* * * * *